US005163630A

United States Patent [19]

Fink

[11] Patent Number: 5,163,630

[45] Date of Patent: Nov. 17, 1992

[54] METHOD AND APPARATUS FOR WINDING YARN

[75] Inventor: Roger H. Fink, Asheville, N.C.

[73] Assignee: BASF Corporation, Parsippany, N.J.

[21] Appl. No.: 598,461

[22] Filed: Oct. 12, 1990

[51] Int. Cl.[5] ..... B65H 67/048

[52] U.S. Cl. ..... 242/18 A; 242/180 PW

[58] Field of Search ..... 242/18 A, 18 PW, 18 DD, 242/25 A, 35.5 A

[56] References Cited

U.S. PATENT DOCUMENTS

| | | | |
|---|---|---|---|
| 3,913,852 | 10/1975 | Lenk et al. | 242/18 A |
| 4,002,307 | 1/1977 | Turk et al. | 242/18 A |
| 4,033,519 | 7/1977 | Abe et al. | 242/18 A |
| 4,210,293 | 7/1980 | Fromaget | 242/18 A |
| 4,336,912 | 6/1982 | Greb | 242/18 PW X |
| 4,351,492 | 9/1982 | Aoyama et al. | 242/18 R |

*Primary Examiner*—Stanley N. Gilreath

[57] ABSTRACT

There is provided an improved method and apparatus for continuously winding yarn on a dual chuck winding machine which utilizes tailmaker cylinders. The tailmaker cylinders are mounted on a bracket which is substantially independent of the vertically upward movement of a take-up head. Thus the tailmaker cylinders will not interfere with apparatus located above the take-up head when the take-up head is at or near its up position.

11 Claims, 6 Drawing Sheets

METHOD AND APPARATUS FOR WINDING YARN

BACKGROUND OF THE INVENTION

This invention relates to yarn winding apparatus. More particularly it relates to dual chuck continuous yarn winding apparatus which utilizes tail making cylinders to begin the winding process on the empty chuck.

Continuous high speed yarn winders are currently available and utilize a pair of chucks which extend from a revolver and which are located below a take-up head which guides the yarn and which drives the yarn packages on the chuck which is in use. One such commercially available winder is the Barmag SW4R Winder which is manufactured by Barmag Barmer Maschinenfabrik Aktiengsellschaft of the Federal Republic of Germany and is commercially available in the United States through American Barmag Corporation of Charlotte, N.C. FIGS. 1, 2 and 3 generally show portions of a Barmag SW4R Winder.

Referring now more particularly to FIGS. 1–3, yarn winding apparatus 10 includes Winder 12 having take-up head 14 mounted above a pair of rotatable chucks 16 and 18. Chuck 16 is shown to contain a pair of yarn packages 20 and 22 which are almost complete therefore doffing of the packages will soon begin. Normally the yarn packages are wound on a bobbin (not shown). Chucks 16 and 18 are connected to revolver 24 which automatically places the chucks in the proper position for winding, tail making, and doffing. Take-up head includes drive roller 26 which makes contact with yarn packages 20 and 22 for rotating the yarn packages and thus chuck 16. Take-up head 14 also includes yarn guide roller 28 for guiding yarn 30 and 32 onto chuck 16.

Apparatus 10 also includes various yarn manipulating apparatus located above winder head 14 such as yarn draw roller 34. Other types of apparatus may be located above the winder head such as texturizing and false twisting apparatus, depending on the end product desired.

A door 36 is attached to take-up head by means of hinge 38. A pair of tailmaker cylinders 40 and 42 are attached to door 36 by mounting brackets 44 and 46. There could be more or less tailmaker cylinders depending on the number of packages which the machine is designed to wind.

FIG. 4 shows one of the tailmaker cylinders 40 with its associated piston 48 in the up position as also shown in FIG. 1 and FIG. 5 shows tailmaker cylinder 40 with its associated piston 48 in the down position for making a tail for beginning a yarn package on chuck 18 as also shown in FIG. 3. Pigtail 50 grabs yarn 30 coming off of yarn roller 28 as the chucks 16 and 18 are rotated clockwise.

Piston 52 connects vertically moving head 14 to the stationary portion 11 of apparatus 10 and causes head 14 to move upwardly or downwardly for its various operations including its movement upwardly as the packages 20 and 22 begin to grow as they are wound. Because tailmaker cylinders 40 and 42 project upwardly above head 14 and are in effect connected to winder head 14 through its connection to door 36, an amount of clearance must be given above winder head 14 to the extent of the highest point reached by the tops of the cylinders. Therefore yarn manipulating apparatus such as draw roller 34 cannot be mounted in this dead space generally indicated as space 54. Because of the movement of these vertically extending tailmaker cylinders, a substantial amount of space is wasted and yarn manufacturing plants must be configured to accommodate these vertically moving cylinders to the detriment of efficient layouts for production.

OBJECTS OF THE INVENTION

It is therefore one object of this invention to provide an improved yarn winder apparatus and method.

It is another object to provide a yarn winder apparatus which utilizes tailmaker cylinders without causing wasted space in a yarn production plant.

It is another object to provide a yarn winding machine which utilizes space more efficiently without interfering with the primary operation of the machine.

SUMMARY OF THE INVENTION

In accordance with one form of this invention there is provided an improved yarn winding apparatus utilizing at least one chuck for receiving yarn. The apparatus includes a take-up head and a mechanism for moving the take-up head in vertical directions. At least one tailmaker cylinder is located adjacent to the take-up head and to the chuck. The tailmaker cylinder is substantially vertically oriented. The tailmaker cylinder is mounted to a bracket. The position of the bracket is substantially independent of the upward movement of the take-up head. Thus the tailmaker cylinder will not move upwardly as the take-up head moves upwardly. Therefore other apparatus may be mounted near to the uppermost extension of the vertical movement of the take-up head without interference by the tailmaker cylinder. Preferably a door is connected to one side of the take-up head and an opening is provided in top of the door which aligns with the tailmaker cylinder permitting the tailmaker cylinder to pass therethrough as the take-up head moves relative to the tailmaker cylinder. It is also preferred that the bracket and the door are mounted to a common rod with a portion of the bracket slidably receiving a portion of the rod.

In another form of this invention there is provided a method for winding yarn onto a chuck utilizing a winding machine having a moveable head and at least one tailmaker cylinder including the steps of: (1) moving the head upwardly while yarn builds on the chuck, and (2) maintaining the tailmaker cylinder in a substantially stationary position relative to the upwardly moving head. It is preferred that the bracket and thus the tailmaker cylinder extend slightly downwardly upon contact with the downwardly moving head to the extent permitted by a tension mechanism.

BRIEF DESCRIPTION OF THE DRAWINGS

The subject matter which is regarded as the invention is set forth in the appended claims. The invention itself, however, together with further objects and advantages thereof may be better understood in reference to the accompanying drawings in which:

DESCRIPTION OF THE PREFERRED EMBODIMENT

Figure 1:
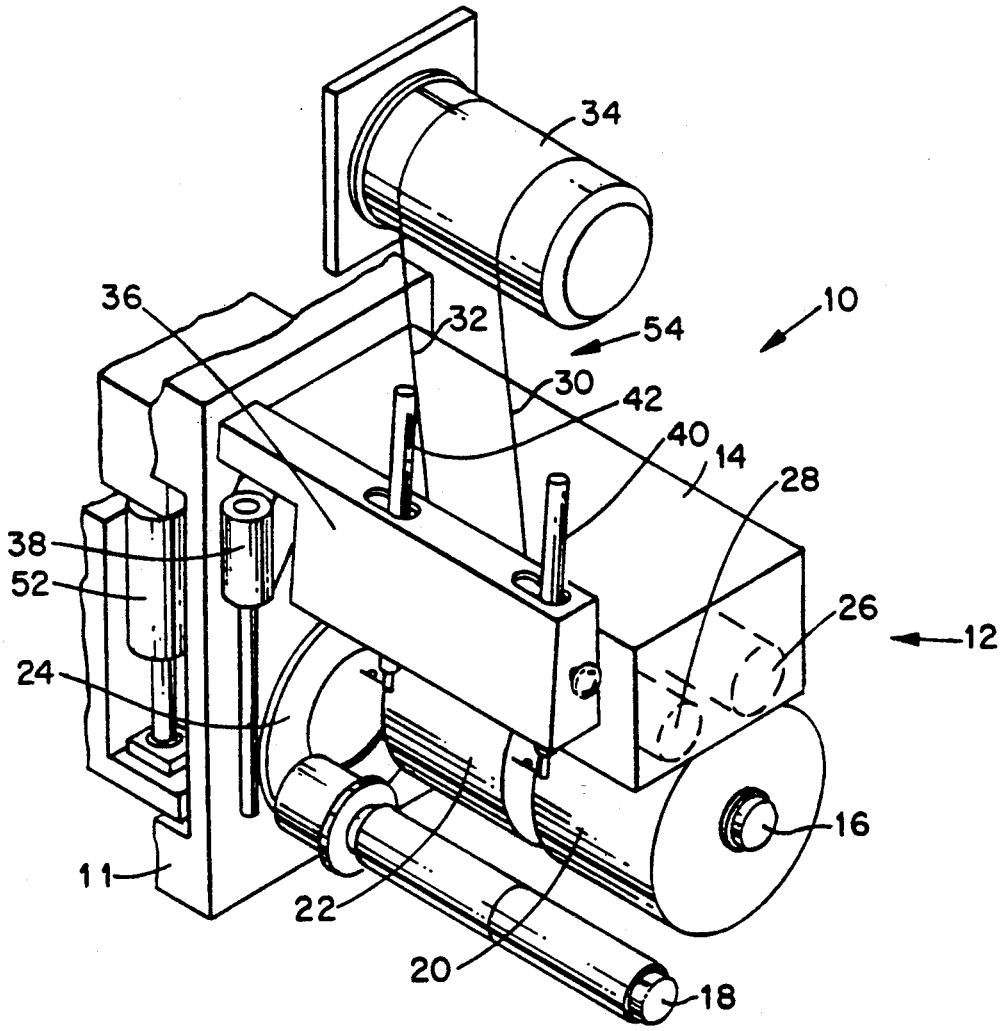
FIGURE 1 (PRIOR ART)
FIG. 1 is a simplified pictorial view of a portion of a prior art winder.
Figure 2:
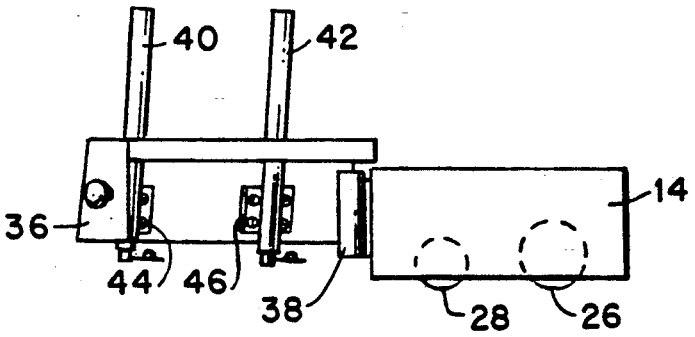
FIGURE 2 (PRIOR ART)
FIG. 2 is a front view of a portion of the winder of FIG. 1 with the door to which the tailmaker cylinders are attached being opened.

Referring now more particularly to FIGS. 6 through 12, there is provided yarn winding apparatus 60 including winder 62. Winder 62 includes take-up head 64 having drive roller 66 and yarn guide roller 68. A pair of chucks 70 and 72 are attached to revolver 74. Chuck 70 is shown carrying yarn packages 76 and 78 and chuck 72 is in the idle position. Door 80 is attached t head 64 through hinge 82 and through magnets (not shown) adjacent to handle 84. Top 86 of door 80 includes openings 88, 90 and 92. Portions of tailmaker cylinders 94 and 96 are received through openings 88 and 90 and a portion of guide rod 98 is received through opening 92.

Bracket 100 is connected to rod 83 through bushing 102. Rod 83 is mounted through hinge 82 to take-up head 64. Bracket 100 is mounted to the stationary portion 104 of the winding apparatus 60 by spring 106 through bolt 108. Spring 106 is connected to bushing 102 by adjustable mounting bracket 110. Spring 106 holds bracket 100 up against stop 117 fixedly connected to stationary portion 104. The tension spring 106 may be varied by connecting the spring at various positions 105, 107, and 109 on mounting bracket 110.

Head 64 is connected to the stationary portion 104 of apparatus 60 through piston 112 which is used to raise and lower head 64.

Figure 7:
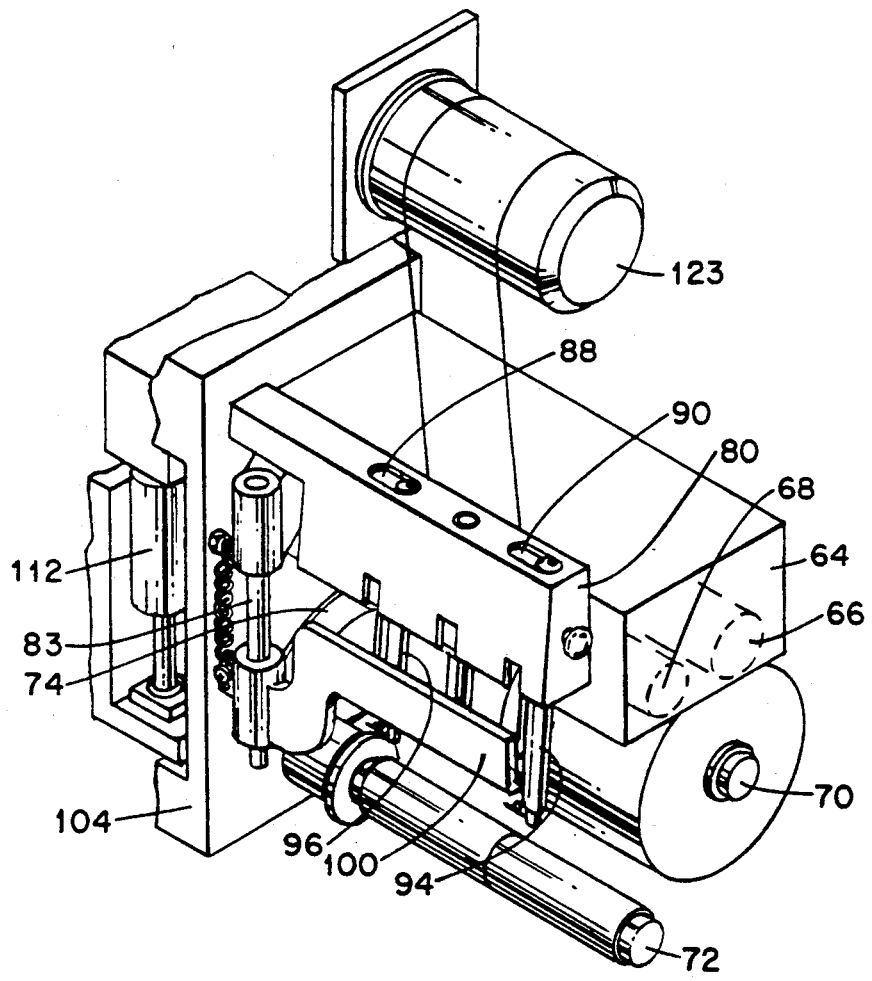
FIG. 7 is a pictorial view of the winder of FIG. 6 but with the take-up head in the up position.
Figure 8:
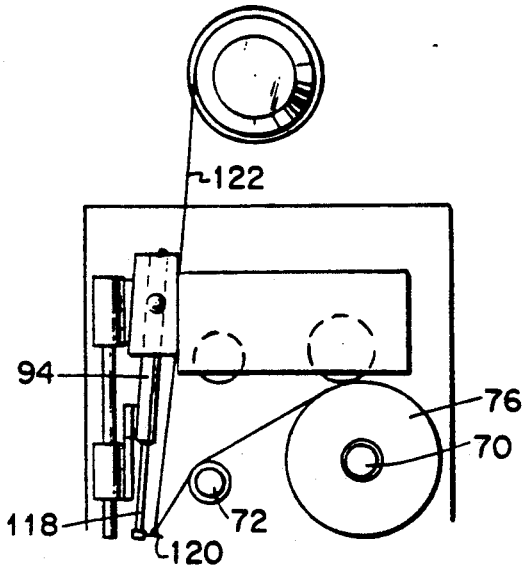
FIG. 8 is a front elevational view of a portion of the winder of FIG. 7.

Tailmaker cylinders 94 and 96 are mounted to bracket 100 through mounting clips 114. As head 64 is forced upwardly by piston 112, the bracket 100 will remain somewhat stationary and openings 88 and 90 which surround tailmaker cylinders 94 and 96 will move upwardly until head 64 reaches its most upward position as shown in FIG. 7 and the tops of the tailmaker cylinders 94 and 96 will be approximately level with the openings 88 and 90. Opening 92 will also move along guide 98. Guide 98 is also connected to bracket 100 through mounting bracket 116.

FIGS. 7, 8, and 10 through 12 show head 64 is in its most upward position. The tailmaker cylinders 94 and 96, however, do not extend above the head as shown in the prior art apparatus of FIG. 1. That is, head 64 moves upwardly independent of the tailmaker cylinders. The tailmaker cylinders however do remain in position to form the yarn tail on chuck 72 shown in FIGS. 7 and 8.

To make the tail the piston portion 118 of cylinder 9 is moved to its extended position with pigtail 120 having made contact with yarn 122 thereby forming the tail on chuck 72 in a known manner.

Figure 3:
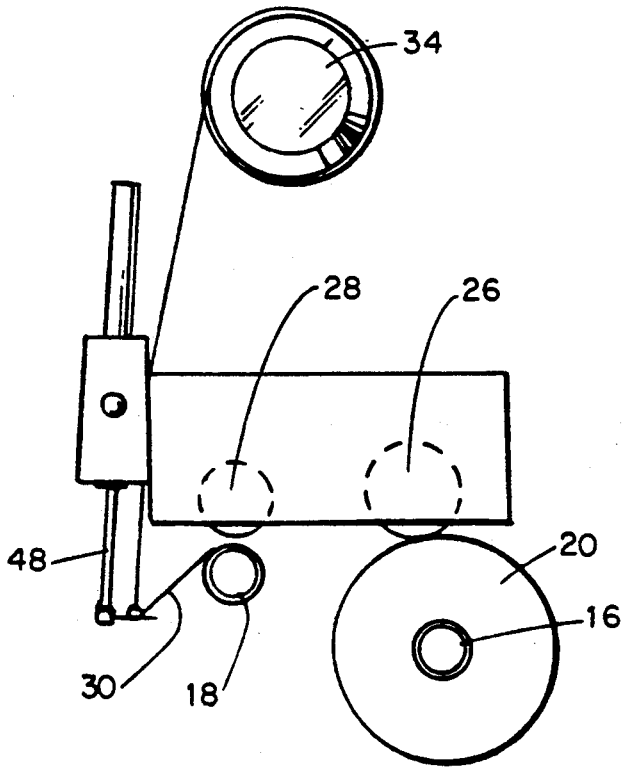
FIGURE 3 (PRIOR ART)
FIG. 3 is a front view of a portion of the winder of FIG. 1 with the chucks and tailmaker cylinders in the tail making position.
Figure 4:
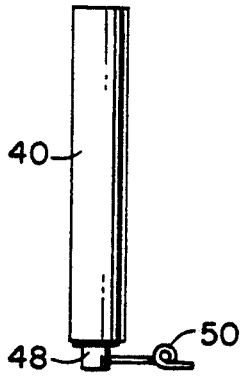
FIGURE 4 (PRIOR ART)
FIG. 4 is a side elevational view of one of the tailmaker cylinders of FIG. 1 with its associated piston in the up position.
Figure 5:
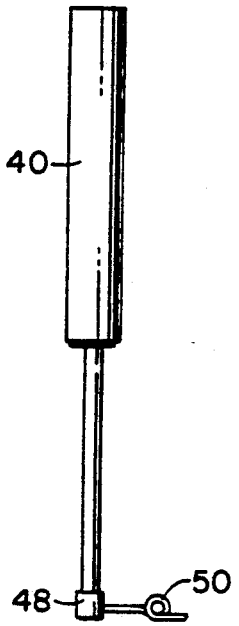
FIGURE 5 (PRIOR ART)
FIG. 5 is a side elevational view of the tailmaker cylinder of FIG. 4 with its associated piston in the down position.
Figure 6:
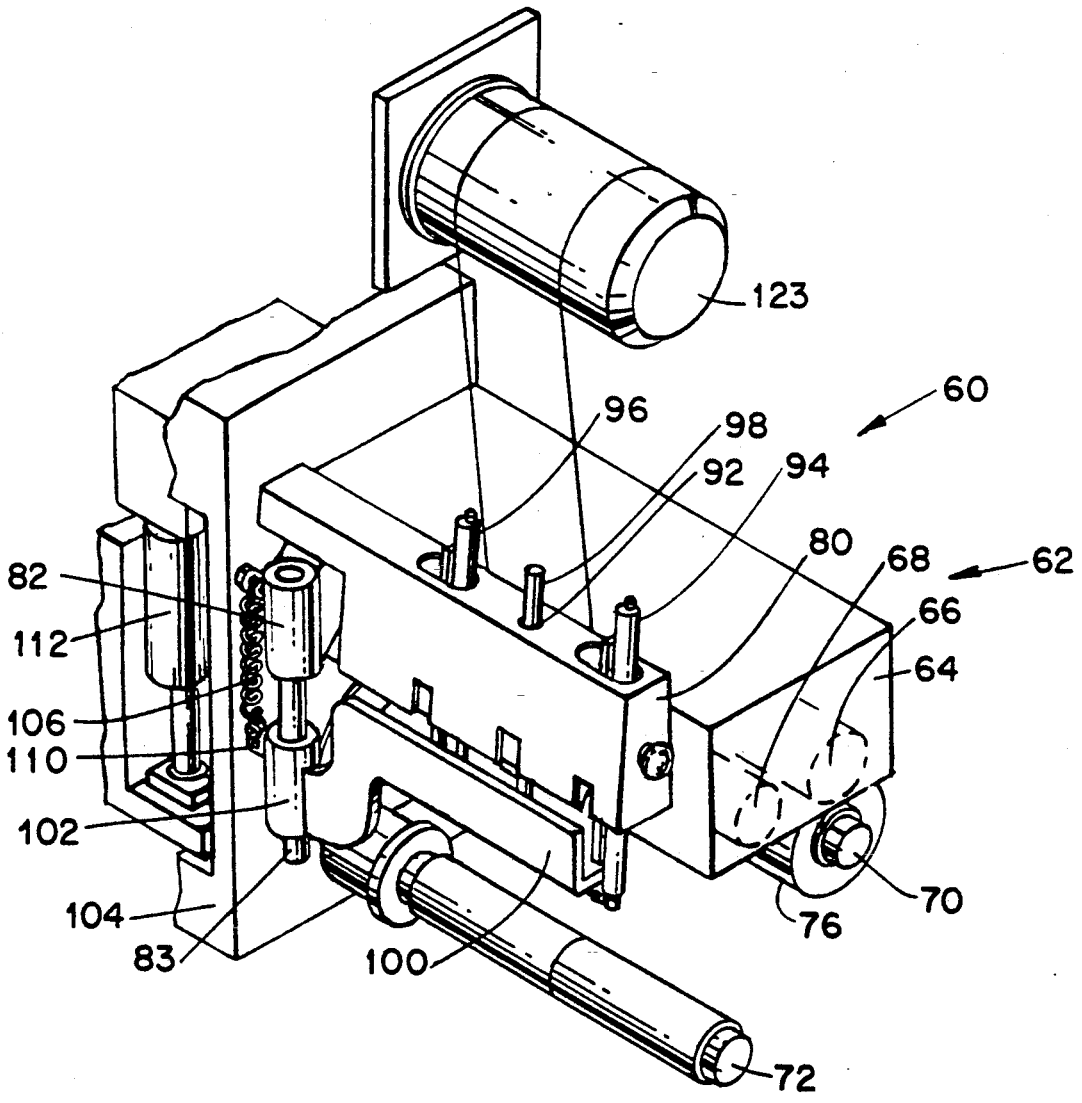
FIG. 6 is a pictorial view of winder incorporating the subject invention with the take-up head in intermediate position.

By utilizing bracket 100 to hold the tailmaker cylinders 94 and 96 and by connecting bracket 100 to rod 83, the tailmaker cylinders do not interfere with apparatus mounted immediately above head 64 such as, for example, draw roller 123, which may be mounted lower than draw roller 34 shown in Prior Art FIGS. 1 and 3.

When door 80 is opened by an operator, bracket 100 swings open with door 80 due to contact between pin 98 and the surface forming opening 92 in the door 80.

Figure 9:
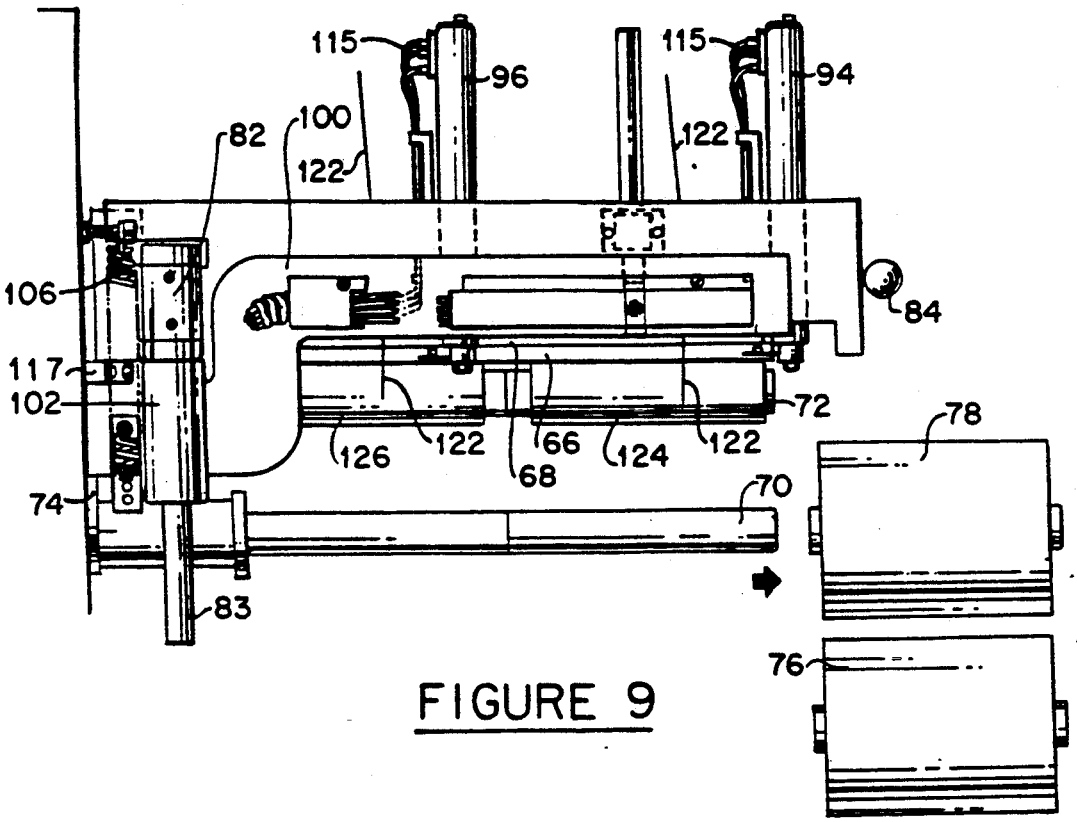
FIG. 9 is a side elevational view of the winder of FIG. 6 but with the take-up head in the down position.
Figure 10:
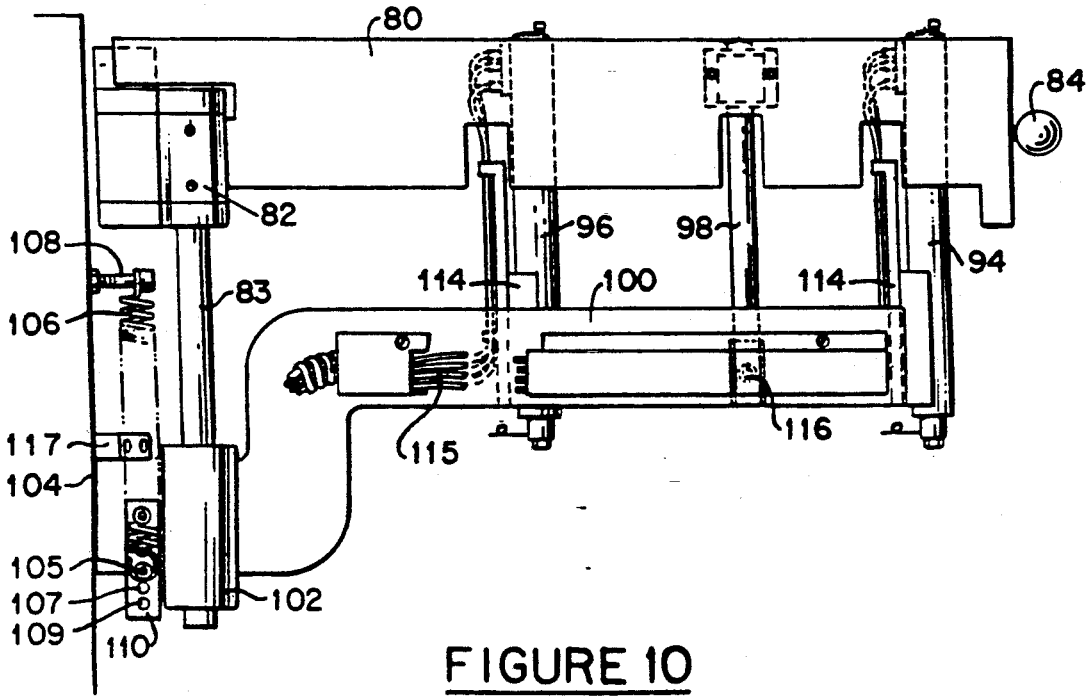
FIG. 10 is a side elevational view of a portion of the winder of FIG. 7.
Figure 11:
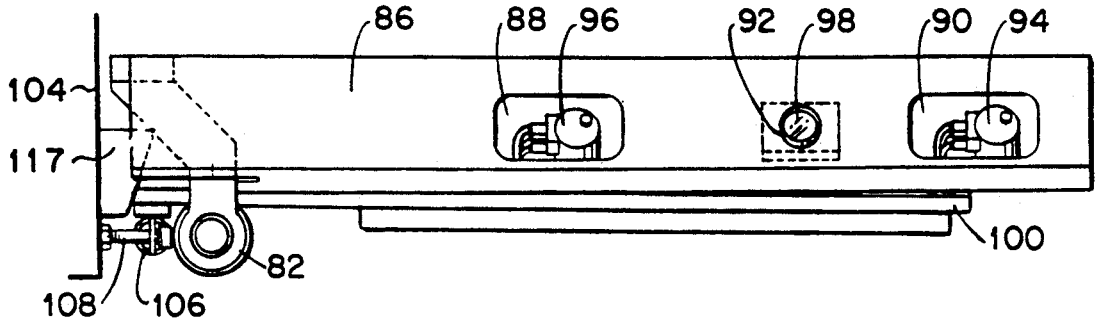
FIG. 11 is a top view showing the door portion of the winder of FIG. 10.
Figure 12:
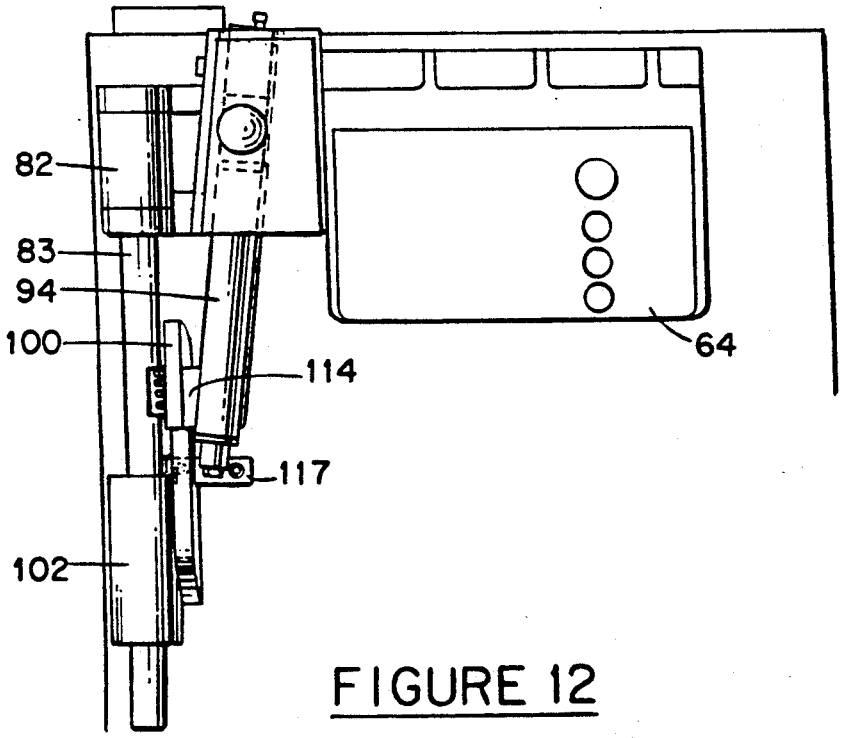
FIG. 12 is a front elevational view of a portion of the winder of FIG. 10.

Packages 76 and 78 are doffed or removed from chuck 70 when those packages are fully wound. Doffing occurs when head 64 is moved to its lowest position as shown in FIG. 9 and at the same time winding of new packages 124 and 126 on chuck 72 begins. When that occurs, hinge 82 contacts bushing 102 placing downward pressure thereon causing spring 106 to expand somewhat, thereby permitting bracket 100 to move somewhat downwardly from stop 117 into the proper doffing position. During the following upward movement of head 64, bushing 102 of bracket 100 contacts again stop 117 whereby stopping bracket 100 from further upward movement of head 64. Thus there is provided an apparatus which eliminates wasted space above a take-up head without interfering in the operation of the winder.

Tailmaker cylinders 94 and 96 are operated by pneumatic means through air hoses 115. Cylinder 52 is also pneumatically operated in a known manner.

The apparatus described above operates as follows: Yarn 122 from draw roller 123 is wound on chuck 70 after passing through guide roller 68 forming packages 76 and 78 which are rotated by contact with drive roller 66. As packages 76 and 78 grow in diameter take-up head moves upwardly as a result of the increased package size and by the action of cylinder 112. When the packages reach a predetermined size the revolver 74 rotates clockwise and the chucks 70 and 72 move to the position shown in FIGS. 7 and 8. Tailmaker cylinders 94 and 96 are passed through holes 88 and 90 and at the highest position of the head 64 the tailmaker cylinders do not extend above the head. Pistons 118 of the tailmaker cylinders extend and turn causing pigtail 120 to catch the yarn and wrap the yarn about chuck 72 forming a tail. The yarn is broken and the piston 118 returns to the inside of each tailmaker cylinder. The revolver 74 rotates more counterclockwise and chuck 72 assumes the previous position of chuck 70 and head 64 moves to its most downward position as shown in FIG. 9. Packages 76 and 78 are doffed and new packages 124 and 126 are then wound on chuck 72.

From the foregoing description of the preferred embodiment of the invention, it will be apparent that many modifications may be made therein without departing from the true spirit and scope of the invention.

I claim:

1. An improved yarn winding apparatus comprising:

a take-up head, moveable in upward and downward direction;

a revolver having two spaced chucks thereon for sequentially moving the chucks between a winding position in engagement with said take-up head and a doffing position remote from that take-up head;

at least two tailmaker cylinders located adjacent to said take-up head;

said tailmaker cylinders being substantially vertically oriented;

a bracket located adjacent to said take-up head, moveable in upward and downward direction;

said tailmaker cylinder mounted to said bracket;

a stop means for a limited upward movement for said bracket; and tension means for biasing the bracket in the upward direction against said stop means;

whereby said take-up head moves upwardly during winding year onto the chuck in the winding position and downwardly during moving a fully wound chuck to the doffing position by said revolver;

said bracket and said tailmaker cylinders being in a stationery position during upward movement of said take-up head during winding;

said bracket and said tailmaker cylinders being moved downwardly by said take-up head during doffing; and said bracket and said tailmaker cylinders being moved upwardly by said tension means as said take-up head moves upwardly until stopped by said stop means.

2. An apparatus as set forth in claim 1 further including means for maintaining said bracket and said tailmaker cylinders oriented with respect to said head.

3. An apparatus as set forth in claim 2 further including a door connected to said head; said door including a top portion; said tip portion of said door having at least two openings therein; said openings aligned with said tailmaker cylinders whereby said openings will move up and down said cylinders as said head is moved upward and downward.

4. An apparatus as set forth in claim 3 further including a hinge connecting said door to said head; said hinge including an elongated pin; said bracket including a bushing; a portion of said pin slidably received in said bushing.

5. An apparatus as set forth in claim 3 further including a third opening in the top of said door receiving said means for maintaining said bracket and sail tailmaker cylinder oriented with respect to said head.

6. An apparatus as set forth in claim 1 wherein said head has at least one up position and at least one down position; said tailmaker cylinders extending higher above said head when said head is in said down position than when said head is in said up position.

7. An apparatus as set for the in claim 1 wherein said tension means is a spring.

8. An apparatus as set forth in claim 1 further including a stationary portion; said means to move said take-up head in upward and downward directions including a cylinder connected to said stationary means and further connected to said take-up head; said bracket connected to said stationary means whereby said take-up head may move relative to said bracket.

9. A method winding yarn onto a chuck utilizing a winding mechanism having a take-up head, moveable in up and downward direction;

a revolver having two spaced chucks thereon for sequentially moving the chucks between a winding position in engagement with said take-up head and a doffing position remote from that take-up head;

at least two tailmaker cylinders located adjacent to said take-up head;

said tailmaker cylinders being substantially vertically oriented;

a bracket adjacent to said take-up head, moveable in upward and downward direction;

said tailmaker cylinders mounted to said bracket;

a stop means for a limited upward movement for said bracket; and tension means for biasing the bracket in the upward direction against said stop means;

comprising the steps of:

(1) moving said take-up head upwardly while winding yarn onto one chuck; maintaining said bracket and said tailmaker cylinders in a stationary position by said stop means while said take-up head is moving upwardly;

(2) said head downwardly when a fully wound yard package is moved to the doffing position by said revolver;

(3) moving said bracket and said tailmaker cylinders downwardly by said take-up head;

(4) moving said take-up head, said bracket and said tailmaker cylinders upwardly when winding yarn onto a chuck moved to the winding position;

(5) stopping the upwardly movement of said bracket and said tailmaker cylinders by said bracket engaging said stop means; and (6) removing said fully wound package.

10. A method as set forth in claim 9 further including the stop of forming a yarn tail on a second chuck with said tailmaker cylinders.

11. A method as set forth in claim 10 further including the step of moving said head downwardly to begin the winding of said yarn on said second chuck, and moving said tailmaker cylinders downwardly in response to a portion of the downward movement of said head.

* * * * *